US009512986B2

(12) United States Patent
Bonadonna

(10) Patent No.: US 9,512,986 B2
(45) Date of Patent: Dec. 6, 2016

(54) NON-COMBUSTIBLE CANDLE APPARATUS FOR USE IN INDOOR AND OUTDOOR SETTINGS

(71) Applicant: Eternal Lite LLC, Denver, CO (US)

(72) Inventor: Nick Bonadonna, Westminster, CO (US)

(73) Assignee: ETERNAL LITE LLC., Denver, CO (US)

( * ) Notice: Subject to any disclaimer, the term of this patent is extended or adjusted under 35 U.S.C. 154(b) by 40 days.

(21) Appl. No.: 13/939,440

(22) Filed: Jul. 11, 2013

(65) Prior Publication Data

US 2014/0016329 A1 Jan. 16, 2014

Related U.S. Application Data

(63) Continuation-in-part of application No. 29/460,363, filed on Jul. 10, 2013, now Pat. No. Des. 743,613.

(60) Provisional application No. 61/670,753, filed on Jul. 12, 2012, provisional application No. 61/837,981, filed on Jun. 21, 2013.

(51) Int. Cl.

| | |
|---|---|
| ***F21V 15/01*** | (2006.01) |
| ***F21S 6/00*** | (2006.01) |
| *F21Y 101/02* | (2006.01) |

(52) U.S. Cl.

CPC ..... *F21V 15/01* (2013.01); *F21S 6/001* (2013.01); *F21Y 2101/02* (2013.01); *Y10T 29/49002* (2015.01)

(58) Field of Classification Search

CPC ..... F21V 15/01; F21S 6/001

See application file for complete search history.

(56) References Cited

U.S. PATENT DOCUMENTS

| | | | | |
|---|---|---|---|---|
| 2,663,866 A * | 12/1953 | Simpson | A47G 19/2227 200/51.12 |
| 2,713,256 A * | 7/1955 | Oesterle | A47G 33/00 431/291 |
| 3,818,208 A * | 6/1974 | Kahl | A47G 19/2227 340/331 |
| 4,006,653 A | 2/1977 | Kuntzsch | |
| 4,507,716 A | 3/1985 | Benedict, Jr. | |
| 5,791,774 A * | 8/1998 | Briles | F21S 6/001 362/153 |

(Continued)

OTHER PUBLICATIONS

International Search Report and Written Opinion dated Oct. 23, 2014, issued in corresponding International Application No. PCT/US14/43443.

*Primary Examiner* — Elmito Breval
(74) *Attorney, Agent, or Firm* — Onello & Mello, LLP.

(57) ABSTRACT

A candle apparatus for emitting light includes a tubular housing having a first end, a second end, and an internal cavity between the first and second ends. The first end is closed to limit access to and from the internal cavity via the first end, and the second end is open to allow access to and from the internal cavity via the second end. The apparatus also includes a receiver disposed within the internal cavity and adjacent the first end of the tubular housing for providing an electrical interconnection to a power source, and a light bulb (e.g., light-emitting diode (LED), incandescent) disposed within the internal cavity and electrically interconnected to the receiver. A tool for removing the bulb may optionally be provided and, when combined with the candle apparatus may form a kit.

20 Claims, 5 Drawing Sheets

(56) References Cited

U.S. PATENT DOCUMENTS

| | | | | | |
|---|---|---|---|---|---|
| 6,140,932 | A * | 10/2000 | Frank | A47G 19/2227 | 206/217 |
| 6,163,248 | A * | 12/2000 | Paek | A47G 19/2227 | 340/321 |
| 6,591,524 | B1 * | 7/2003 | Lewis | A47G 19/2227 | 310/339 |
| 6,685,345 | B1 | 2/2004 | Velasquez | | |
| 8,412,029 | B2 * | 4/2013 | Browder | A61L 9/015 | 392/386 |
| 2002/0080604 | A1 | 6/2002 | Niermann | | |
| 2005/0207141 | A1 * | 9/2005 | Boesch | A47G 19/2227 | 362/101 |
| 2007/0206372 | A1 * | 9/2007 | Casillas | B65D 23/00 | 362/101 |
| 2007/0236948 | A1 * | 10/2007 | Restell | C11C 5/008 | 362/392 |

* cited by examiner

NON-COMBUSTIBLE CANDLE APPARATUS FOR USE IN INDOOR AND OUTDOOR SETTINGS

CROSS REFERENCE TO RELATED APPLICATION

The present invention claims priority to U.S. Provisional Patent Application 61/670,753 under 35 USC §119 entitled NON-COMBUSTIBLE CANDLE APPARATUS FOR USE IN INDOOR AND OUTDOOR SETTINGS, filed on Jul. 12, 2012, and to U.S. Provisional Patent Application 61/837,981 under 35 USC §119 entitled NON-COMBUSTIBLE CANDLE APPARATUS FOR USE IN INDOOR AND OUTDOOR SETTINGS, filed on Jun. 21, 2013, and is also a continuation-in-part application that claims the benefit of priority under 35 U.S.C. §120 from U.S. Design application Ser. No. 29/460,363, entitled NON-COMBUSTIBLE CANDLE APPARATUS, filed on Jul. 10, 2013, which are each incorporated herein by reference in its entirety.

FIELD

The present invention relates to a candle apparatus and, more particularly, to a candle apparatus that emulates a candle by providing the appearance of a flame without generating an actual flame.

BACKGROUND

Traditionally, candles have been constructed out of solid blocks of fuel (e.g., wax) including embedded wicks which, when lit, provided light and oftentimes a measureable amount of heat. More recently, candles have been made of one or more of paraffin (a byproduct of petroleum refining), beeswax, soy, other plant waxes, and/or tallow (a by-product of beef-fat rendering). Additionally, gel candles are sometimes manufactured from a mixture of paraffin and plastic. A wide variety of devices to hold candles exist, from simple tabletop candle holders (e.g., candlesticks) up to elaborate chandeliers.

After the wick is lit (e.g., with a match or lighter), the heat from the lit wick eventually causes a small portion of the wax or other fuel of the candle to melt and vaporize. Once vaporized, the fuel combines with oxygen in the atmosphere to form a flame. This flame provides sufficient heat to keep the candle burning by way of a self-sustaining chain of events: the heat of the flame melts the top of the mass of solid fuel, the liquefied fuel then moves upward through the wick via capillary action, and the liquefied fuel is then vaporized to burn within the candle's flame.

Candles have been used for illumination since before the advent of electricity and in areas without electricity. In the developed world today, candles are used mainly for their aesthetic value and scent, particularly to set a soft, warm, or romantic ambiance, and for emergency lighting during electrical power failures. For instance, scented candles are often used in aromatherapy.

Candles are also used in the religious practices and/or ceremonies of many faiths. For instance, candles are often lit both at dawn and at dusk in many Hindu homes, and some even maintain lighting of the candles continuously between dawn and dusk. As another example, the candle is commonly used in worship both for decoration and ambiance in the Christian faith, e.g., as a symbol that represents the light of God or, specifically, the light of Jesus Christ.

However, candles are one of the leading sources of residential fires in the United States, with almost 10% of civilian injuries and 6% of civilian fatalities from fire attributed to candles. For instance, candles are oftentimes inadvertently knocked over resulting in a spillage of hot wax and/or the contact of the flame with unintended ignitable objects (e.g., drapes, carpet, etc.). Furthermore, a candle flame that is longer than its laminar smoke point often emits soot that, when inhaled, has been known to cause health hazards. Still further, allowing a candle to burn continuously results continuous melting of the wax or other fuel and the premature loss of use of the candle.

SUMMARY

To limit or at least reduce some of the problems and inefficiencies present in or associated with existing candles, disclosed herein are systems, apparatuses, and methods that make use of one or more types of lamps or light bulbs to simulate the light that would otherwise be generated by the flame of combusting fuel. In some embodiments, a candle apparatus includes a body or housing, e.g., a vase, a jar, or a tubular structure, constructed of any appropriate material, such as glass, to simulate the appearance of a candle holder, a light bulb (e.g., light emitting diode (LED), incandescent, compact florescent, etc.) that may be appropriately disposed within an interior of the housing (e.g., adjacent a bottom of the housing), and any appropriate electrical connection (e.g., socket) for providing electricity to the bulb (e.g., DC current via a battery, AC current via plugging into an outlet). The housing may be tubular, polygonal, or other shape. As the disclosed utilities may not be subject to the above-discussed risks associated with candles that rely on fuel combustion (e.g., wax spillage, open flame contact with surrounding items, inhaling of soot, etc.), the utilities may advantageously be used in indoor environments (e.g., hospitals, churches, homes, etc.).

In one aspect, a utility for emitting light includes a tubular housing having a first end, a second end, and an internal cavity between the first and second ends. The first end is closed to limit access to and from the internal cavity via the first end, and the second end is open to allow access to and from the internal cavity via the second end. The utility also includes a receiver disposed within the internal cavity and adjacent the first end of the tubular housing for providing an electrical interconnection to a power source, and a light bulb disposed within the internal cavity and electrically interconnected to the receiver. The light bulb is operable to emit light through the second end of the tubular housing when the power source supplies electricity to the receiver.

The receiver may include an electrically conductive socket and the light bulb may include an outer bulb and an electrically conductive base that is received in the electrically conductive socket. For instance, the socket may include a pair of contacts that are operable to contact a corresponding pair of electrical contacts of the base.

In one arrangement, the apparatus may include a mains cable (e.g., power cord) having first and second ends, where the first end is electrically connected to the receiver and the second end (e.g., including an electrical plug) is operable to be electrically connected to a mains electricity or power supply. For instance, the mains cable may extend through an opening disposed in the tubular housing. In one variation, the mains cable may extend through a grommet received in the opening so as to limit movement of the cable into and out of the internal cavity of the tubular housing, and the grommet may have any appropriate features to aid in this regard (e.g., resilient protrusions).

In another arrangement, the apparatus may include an opening disposed in the tubular housing that is sized to receive at least one battery. A pair of electrical contacts may be disposed within the opening and electrically connected to the receiver establishing an electrical connection with the at least one battery. The opening may be coverable by a removable door. In a further arrangement, the apparatus may include a switch that is electrically connected to the receiver that is operable to selectively limit or allow the flow of electricity to the light bulb.

In accordance with another aspect, provided is an apparatus that emulates a candle. The apparatus comprises a housing including a first end, a second end, and an internal cavity between the first and second ends, wherein the first end includes a bottom that controls or prevents access to and from the internal cavity via the first end, and wherein the second end includes an opening that allows access to and from the internal cavity via the second end; a receiver disposed within the internal cavity and proximate the first end of the housing, and including an electrical interconnection to a power source; and a light bulb positioned at the internal cavity and electrically interconnected to the receiver, wherein the light bulb emits light through the tubular housing in response to the power source supplying electricity to the receiver via a power cord.

The apparatus may further comprise an opening extending through the tubular housing and a grommet disposed in the opening, wherein the power cord extends through the grommet.

The grommet may include a detent configured to prevent the grommet from passing through the opening.

The grommet may be configured to prevent movement of the power cord with respect to the tubular housing.

The apparatus may further comprise a switch that is electrically connected to the receiver, wherein the switch is operable to selectively limit or allow the flow of electricity from the power source to the light bulb.

The switch may be an in-line switch disposed within the power cord.

The apparatus may further comprise at least one sleeve disposed on an outer surface of the housing and having a semitransparent graphic.

The apparatus may further comprise at least one semitransparent graphic formed in or on an outer surface of the housing.

The housing may be a tubular glass housing.

The light bulb may be disposed within a bottom third of the housing.

The receiver may be mounted to the first end of the housing.

The light bulb may comprise a light emitting diode (LED) light bulb.

In accordance with another aspect of the invention, provided is a candle apparatus kit. The kit comprises: a tubular housing including a first end, a second end, and an internal cavity between the first and second ends, wherein the first end includes a bottom that controls or prevents access to and from the internal cavity via the first end, and wherein the second end includes an opening that allows access to and from the internal cavity via the second end; a receiver disposed within the internal cavity and proximate the first end of the housing, and including an electrical interconnection to a power source; a light bulb positioned at the internal cavity and electrically interconnected to the receiver, wherein the light bulb emits light through the tubular housing in response to the power source supplying electricity to the receiver via a power cord; and a light bulb removal tool. The tool comprises: an elongated body having a proximal end for use by a user and a distal end configured to removably couple to a bulb; and a bulb receiver and grip formed at the distal end and configured to receive and grip the bulb, wherein the tool is configured to apply a rotational force to the bulb in response to a user action applied to the proximal end of the body.

The kit may further comprise an opening extending through the tubular housing and a grommet disposed in the opening, wherein the power cord extends through the grommet.

The grommet may include a detent configured to prevent the grommet from passing through the opening and the grommet may be configured to prevent movement of the power cord with respect to the tubular housing.

The kit may further comprise an switch that is electrically connected to the receiver, wherein the switch is operable to selectively limit or allow the flow of electricity from the power source to the light bulb, wherein the switch may be an in-line switch disposed within the power cord.

The kit may further comprise at least one sleeve disposed on an outer surface of the housing and having a semitransparent graphic.

The kit may further comprise at least one semitransparent graphic formed in or on an outer surface of the housing.

The light bulb may be disposed within a bottom third of the housing.

According to another aspect of the invention, provided is a method of making a candle apparatus. The method comprises: providing a tubular housing including a first end, a second end, and an internal cavity between the first and second ends, wherein the first end includes a bottom that controls or prevents access to and from the internal cavity via the first end, and wherein the second end includes an opening that allows access to and from the internal cavity via the second end; forming an opening near the first end and in a side of the housing, the opening configured to receive a power cord; installing a receiver within the internal cavity, the receiver configured to secure a light bulb for illumination; extending an external power cord through the opening to the receiver, and electrically coupling the power cord to the receiver; mounting the receiver proximate to the first end of the housing; and mounting a light bulb within the receiver.

According to another aspect of the invention, provided is a method of removing a light bulb from an apparatus for emitting light, wherein the bulb is disposed at a depth within the apparatus. The method comprises: inserting a distal end of a tool into an internal cavity of the apparatus, the distal end including an opening for conformably receiving and temporarily coupling to at least a portion of the light bulb; applying a force to the tool that translates to a rotational force applied by the tool to the light bulb; and removing the tool and the temporarily coupled light bulb from the internal cavity.

DETAILED DESCRIPTION

Reference will now be made to the accompanying drawings, which assist in illustrating the various pertinent features of the various novel aspects of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

Figure 1:
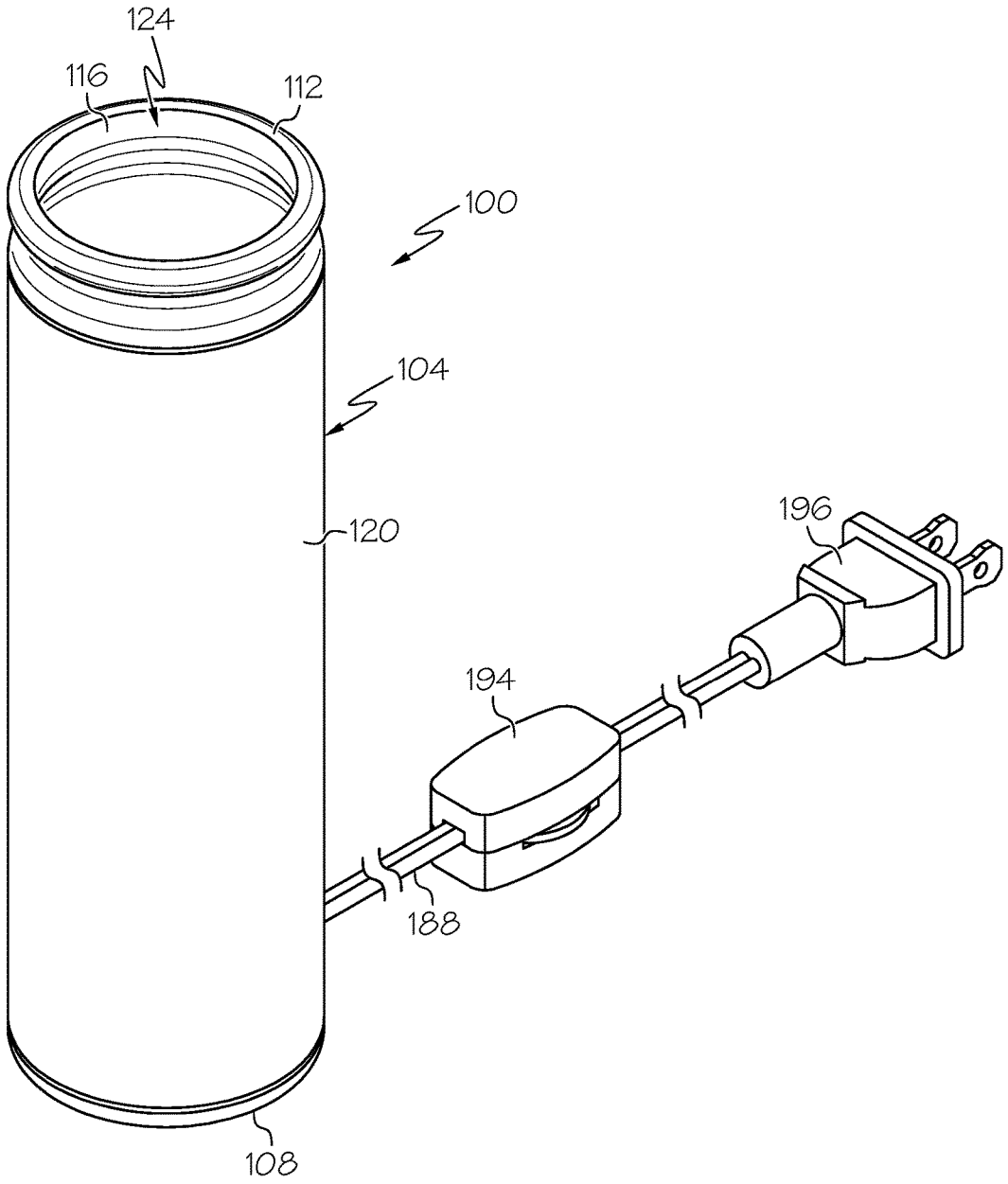
FIG. 1 is a perspective view of an embodiment of a candle apparatus according to one aspect of the present invention.
Figure 2:
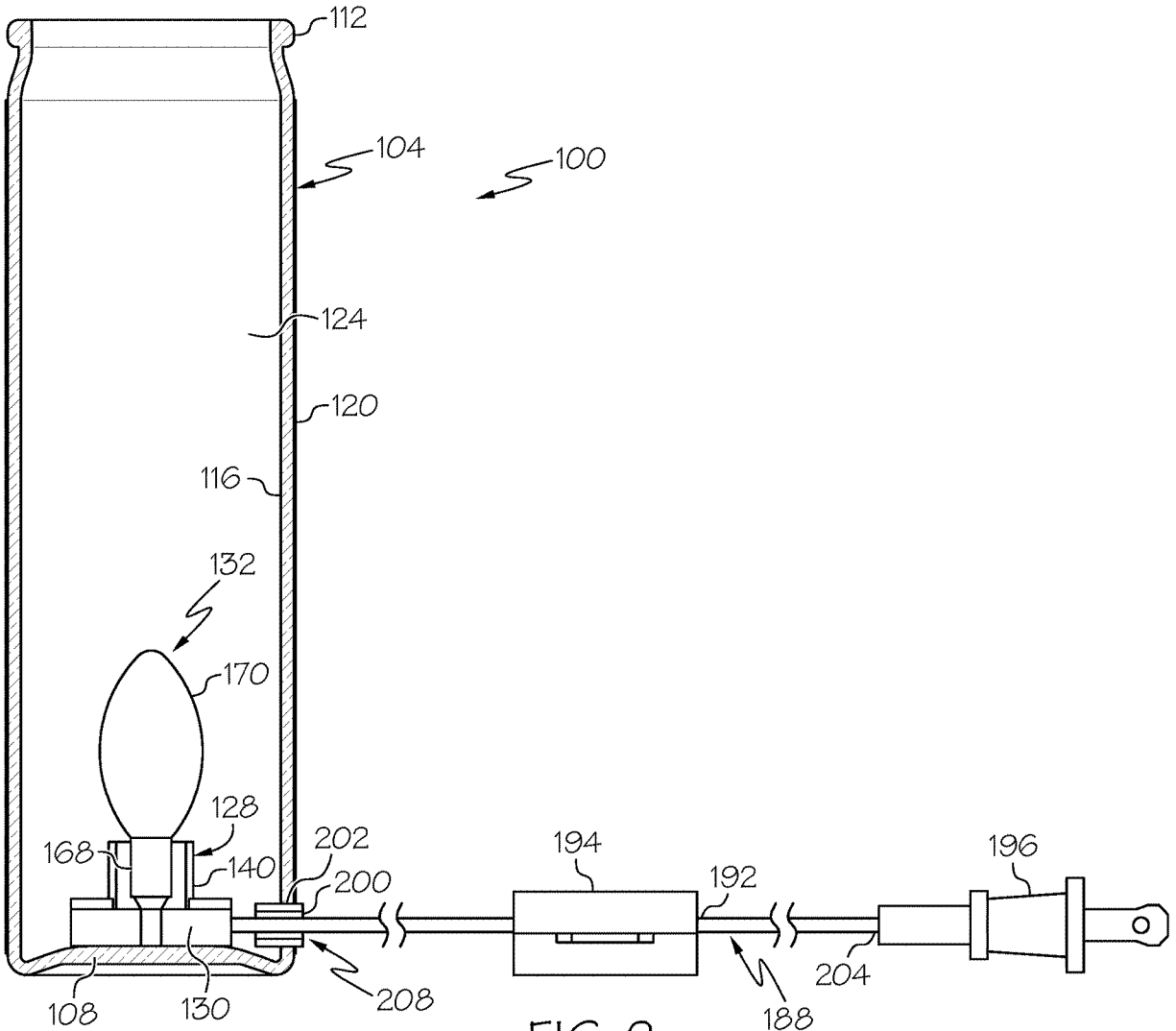
FIG. 2 is a cross-sectional side view of the candle apparatus of FIG. 1.

FIGS. 1-2 respectively illustrate perspective and side views of an embodiment of a candle apparatus, according to aspects of the present invention. In this embodiment, the candle apparatus 100 generally includes a tubular body 104 having first and second ends 108, 112, inner that collectively define an internal cavity 124 extending between the first and second ends 108, 112. An outer surface 120 of candle apparatus 100 may include a pattern or image that is illuminated by a bulb 132 disposed within the tubular body 104, e.g., a symbol that represents the light of God or, specifically, the light of Jesus Christ. In some embodiments, outer surface 120 may take the form of a semitransparent sleeve that is adhered to or disposed over or around at least a portion of the tubular body 104. The sleeve may include the pattern or image to be illuminated. In other embodiments, the tubular body itself may be semitransparent and patterned to achieve a same or similar illumination effect.

The first end 108 may be closed to generally limit access to and from the internal cavity via the first end. Here, a separate cap, lid, or other covering can be positioned over the first end 108. Alternatively, the tubular body 104 and the covering can be formed, for example, molded, from a common material, so that a single piece of material provides both the tubular body 104 and the covering at the first end 108. In such a case, the first end may be considered to be integral with the tubular body 104. For example, tubular body 104 and first end 108 may be made as a single elongated glass body or structure having an internal cavity or recess configured to house bulb 132 and associated parts and/or materials configured to hold and power the bulb.

The second end 112 may be open to allow access to and from the internal cavity 124 via the second end 112, for reasons that will be discussed more fully below. The body 104 may be constructed to have any appropriate dimensions.

In one arrangement, the body 104 may be about 8 inches tall with a diameter of about 3 inches. In some embodiments, the bulb may be disposed in the bottom third of the body 104, e.g., substantially resting on or within two inches above first end 108.

The associated parts and/or materials configured to hold and power the light bulb 132 may be generally be referred to as a receiver 128 positioned in the internal cavity 124.

Figure 3:
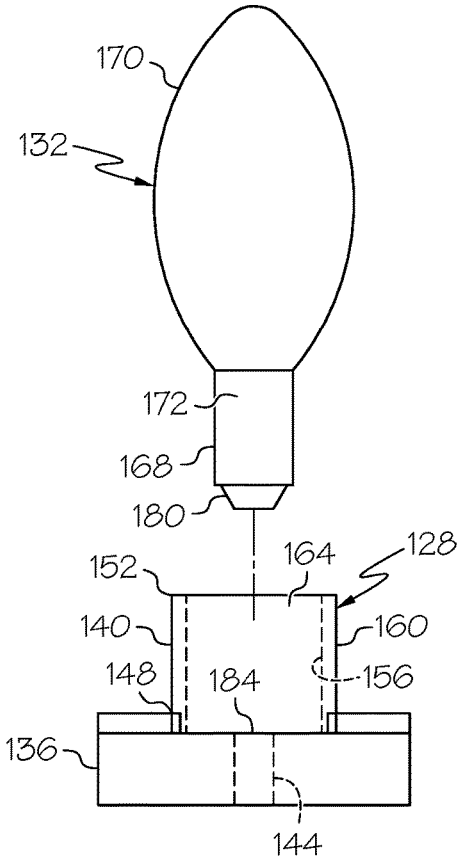
FIG. 3 is an exploded view of a receiver and a light bulb of the candle apparatus of FIG. 1.
Figure 4:
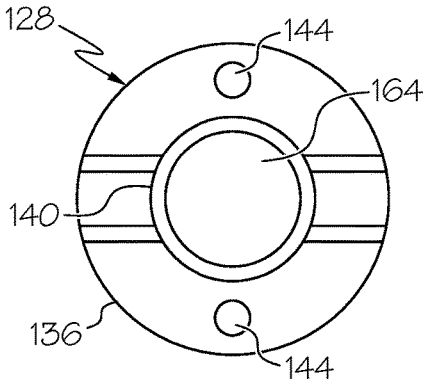
FIG. 4 is a plan view of the receiver of FIG. 3.

FIG. 3 is an exploded view of an embodiment of the receiver 128 and light bulb 132 of the candle apparatus 100 of FIGS. 1 and 2. FIG. 4 is a plan view of the receiver 128 of FIG. 3.

Receiver 128 may be disposed within the internal cavity 124 and adjacent or proximate to the first end 108. Receiver 128 is configured to maintain the bulb 132 and provide for the use of electrically in powering light bulb 132. The light bulb 132 can be an LED, incandescent, compact florescent, or of another light bulb type and configuration known to those of ordinary skill in the art. The light bulb 132 can have an electrically conductive base 168 supporting an outer bulb 170, which can communicate with any appropriate power source, such as an electrical socket.

In one arrangement, the receiver 128 may include a support 136 that mounts and/or supports the receiver 128 on, to, or proximate to the first end 108 of the body 104. Receiver 128 can further include a socket 140, supported by support 136, wherein the socket 140 is configured to receive the light bulb 132 and establishing an electrical connection therewith. For instance, the receiver 128 may be a candelabra-type socket having one or more mounting clips on an inner wall of the socket 140 or it may be threaded to receive a correspondingly threaded bulb. The receiver 128 may have any appropriate dimensions suitable for positioning in the internal cavity 124 and for receiving the bulb 132 in socket 140. In one arrangement, the receiver 128 may have a height of between about 1-2", such as between about 1¼" and 1¾", and an inner diameter of between about ¾" and 1¼".

The support 136 may be disposed at, e.g., coupled to or rest on, a bottom region of the body 104 at or near the first end 108 in any appropriate manner. In one arrangement, the support 136 may include one or more mounting holes 144 disposed therethrough that are respectively sized to receive one or more fasteners (e.g., bolts, not shown). For instance, the mounting holes 144 may be aligned with respective holes (not shown) disposed at least partially through the first end 108, and the fasteners may be threaded or otherwise inserted through the aligned sets of openings to mount the receiver 128 to the first end 108. In another embodiment, the first end may include one or more upward projections configured to extend through mounting holes 144. Although, such manners of mounting or positioning receiver 128 are not essential to the present invention.

Furthermore, the socket 140 may have first and second ends 148, 152, inner and outer surfaces 156, 160 and define an internal cavity 164 configured to receive the base 168 of the light bulb 132. The socket first end 148 may be coupled to the support 136 in any appropriate manner (e.g., formed as one piece with the base 136, welded or glued to the base, etc.).

The socket 140 may include any appropriate feature(s) for removably fixing the light bulb 132 to the receiver 128. In one arrangement, the inner surface 156 of the socket 140 may include a series of threads (not shown) designed to mate with a corresponding series of threads (not shown) on an outer surface 172 of the base 168 of the light bulb 132. In another arrangement, a top portion 176 of the support 136 of the receiver 128 may have one or more features (e.g., opposing keyhole shaped slots) that are sized to receive corresponding features (projections with widened heads) on the base 168 of the light bulb 132. In this arrangement, the projections may be inserted into the slots and then the light bulb 132 may be twisted to removably lock the light bulb 132 to the receiver 128, as is known in the art.

In any event, at least two electrical connections may be established between the base 168 of the light bulb 132 and the receiver 128 when the base 168 is mounted in the socket 140 to allow for a current to be passed through illumination components (not shown) within the outer bulb 170 and thus light may be emitted from the outer bulb 170.

For instance, circuitry within the outer bulb 170 may include a plurality of LEDs, where each LED includes a cathode lead and an anode lead respectively interconnected to an LED chip or diode for emitting light. In one arrangement, at least a portion of the outer surface 172 of the base 168 of the light bulb 132 may be made of a conductive material (e.g., metal) that is electrically connected to the circuitry within the outer bulb 170, and at least a portion of the inner surface 156 of the socket 140 may be made of a conductive material (e.g., metal) that is electrically connected to a power source as will be described in more detail below. In this regard, contacting the outer surface 172 of the base 168 with the inner surface 156 of the socket 140 may serve to establish a neutral connection between the circuitry in the outer bulb 170 and the power supply. Additionally, the base 168 of the light bulb 132 may include a conductive contact 180 that is designed to contact a corresponding conductive contact 184 on the top portion 176 of the support 136 of the receiver 128 to establish a "hot" connection between the circuitry in the outer bulb 170 and the power supply. In one arrangement, the light bulb 132 may be a 1.5 W light bulb (e.g., a 1.5 W LED or incandescent light bulb) that produces a flickering effect to simulate an actual flame. In another arrangement, the light bulb 132 may be a 7 W light bulb, as an example. The present invention is not limited by bulb type.

In another arrangement, and in the case where the top portion 176 of the support 136 of the receiver 128 has opposing slots that are sized to receive corresponding projections on the base 168 of the light bulb 132, one of the projections may contact a conductive contact within or adjacent one of the slots to establish a neutral connection between the circuitry in the outer bulb 170 and the power supply, and the other of the projections may contact a conductive contact within or adjacent the other of the slots to establish a hot connection between the circuitry in the outer bulb 170 and the power supply. In some variations, any appropriate epoxy may be used to cover or encase one or more of the conductive contact, projections, and the like. Other arrangements are also envisioned and encompassed within the scope of the present disclosure.

The candle apparatus 100 may include any appropriate arrangement to interconnect the receiver 128 and the light bulb 132 to a power source, for example, an alternating current (AC) power supply. In one arrangement, and turning to FIGS. 1-2, the apparatus 100 may include a main cable 188 having a flexible cord 192 and a plug 196 having at least two prongs that may be appropriately connected to a power source, e.g., via inserting the plug into an electrical outlet. The cord 192 may have a first end 200 that may be inserted through an opening 202 in the body 104 and electrically interconnected to the receiver 128 and a second end 204 that is electrically connected to the plug 196. For instance, the cord 192 may include a neutral wire that is electrically connected to the inner wall 156 of the socket 140 of the receiver 128 (or other neutral contact of the receiver 128) and one of the prongs of the plug 196, and a "hot" wire that is electrically connected to the conductive contact 184 on the top portion of the support 136 (or other hot contact of the receiver 128) and the other of the prongs of the plug 196 in any appropriate manner, e.g., welding, wire nuts, etc. That is, main cable 188 may be a standard A/C power cord, optionally including an in-line switch 194.

In one embodiment, a grommet 208 is used to provide a protective passage of the cord 192 through the tubular body 104, as shown. Grommet 208 may be configured to also secure the cord 192 to the body 104 so as to limit movement of the cord 192 at least one of into or out of the internal cavity 124 of the body 104.

Figure 5:
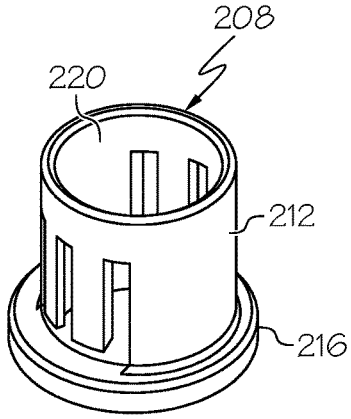
FIG. 5 is a perspective view of an embodiment of a grommet usable with the candle apparatus of FIG. 1.

With reference now to FIGS. 2 and 5, the grommet 208 may include a housing 212 that is interconnected to a detent 216. The housing 212 may be tubular, polygonal, or other shape. For example, the housing 212 may be square or hexagon shaped from a top-view perspective. The housing 212 and detent 216 define an aperture 220 extending therethrough that is sized to receive and surround the cord 192 in any appropriate manner. For instance, the cord 192 may be inserted through the aperture 220, and the second end 200 may be inserted through the opening 202 in the body 104 and appropriately electrically connected to the receiver 128. Thereafter, the housing 212 of the grommet 208 may be inserted into the opening 202 in the body 104 so that the detent 216 lies close to or in contact with the outer surface 120 of the body 104, and prevents the grommet 208 from passing completely through opening 202 and internal to tubular body 104.

In one arrangement, the housing 212 of the grommet 208 may be press fit into the opening 202 of the body 104. In another arrangement, the housing 212 of the grommet 208 may include any appropriate feature(s) such as spring arms, protrusions, and so on that function to limit movement of the grommet 208 in a direction away from the internal cavity 124 of the body 104. Still further, the housing 212 of the grommet 208 may include any appropriate feature(s) to limit movement of the cord 192 at least one of into and out of the internal cavity 124, such as spring arms, protrusions, and so on.

In another arrangement, and although not shown, the candle apparatus 100 may include an opening disposed in the tubular housing 104 that is sized to receive at least one battery. For instance, a pair of electrical contacts, e.g., a spring tab and fixed contact, may be disposed within the opening, where one of the contacts may be electrically connected to the neutral contact of the receiver 128 and the other of the contacts may be electrically connected to the hot contact of the receiver 128. In this case, the battery may be disposed in the opening so that the positive side of the battery is electrically connected to one of the contacts and the negative side of the battery is electrically connected to the other of the contacts to supply power to the circuitry in the outer bulb 170.

The candle apparatus 100 may include a switch 194 in any appropriate location, e.g., on the outer surface 120 of the body 104, on the cord 192 of the mains cable 188 (as shown in FIGS. 1 and 2), that is operable to, when manipulated (e.g., flipped, pressed, etc.), selectively allow or deny current flow to the circuitry of the outer bulb 170. In one arrangement, the cord 192 may be SPT-1 cord (e.g., 6') that is UL rated with an on/off roller switch 194.

Once the receiver 128 is appropriately mounted within the internal cavity 124 at the first end 108 of the body 104 and appropriately interconnected to an arrangement, e.g., main cable 188, opposing contacts of a battery opening, etc., to allow for connection with a power supply, the base 168 of light bulb 132 may be threaded or otherwise inserted into the socket 140 of receiver 128 to establish an electrical connection between the circuitry in the outer bulb 170 of the light bulb 132 and the receiver 128. Thereafter, current may be allowed to flow through the circuitry in the outer bulb 170 by inserting plug 196 into an outlet, inserting a battery into the opening having opposing contacts, etc., either of which may or may not require manipulating a switch as discussed above for the delivery of electrical current.

With reference again to FIG. 2, it can be seen and understood that light emitted from the outer bulb 170 of light bulb 132 may generally travel away from the first end 108 of the body 104 through the internal cavity 124 and out of the second end 112 of the body in a manner similar to the light emitted from the flame of a traditional candle resulting from a combustion of a fuel. In addition, the light emitted from the outer bulb 170 can illuminate the internal cavity 124. At least some of the emitted light may be seen through the outer surface 120 of the candle apparatus 100, for example, a glass surface. In some embodiments, a wrapper having a design can be disposed over at least a portion of the tubular body 104 to form at least part of the surface 120. Here, at least some of the emitted light may also be seen through the wrapper, which may be semitransparent.

Unlike traditional candles, the non-flame candle apparatus 100 disclosed herein poses far less risk of causing inadvertent fires, soot emission, and the like. As an NC electrical candle apparatus 100, the present invention combines safety with longevity and convenience, since batteries need not be included. In various embodiments, the candle apparatus 100 is well suited for use in both indoor and outdoor environments for numerous purposes.

Furthermore, use of the light bulb 132 instead of an open flame affords a greater range of potential materials with which to construct the apparatus 100. For instance, the body 104 may be constructed of glass, and/or various types of plastics and the like. To reduce scattering of the light before exiting the internal cavity 124 at the second end 112 of the body 104, the body 104 may be constructed of or otherwise include any appropriate opaque material, surface, coating or the like.

Since the candle apparatus 100 provides a safer alternative to traditional flammable candles, use by the elderly, children, various handicapped individuals and others may be made possible, where heretofore they may have been consider too unsafe.

Figure 6:
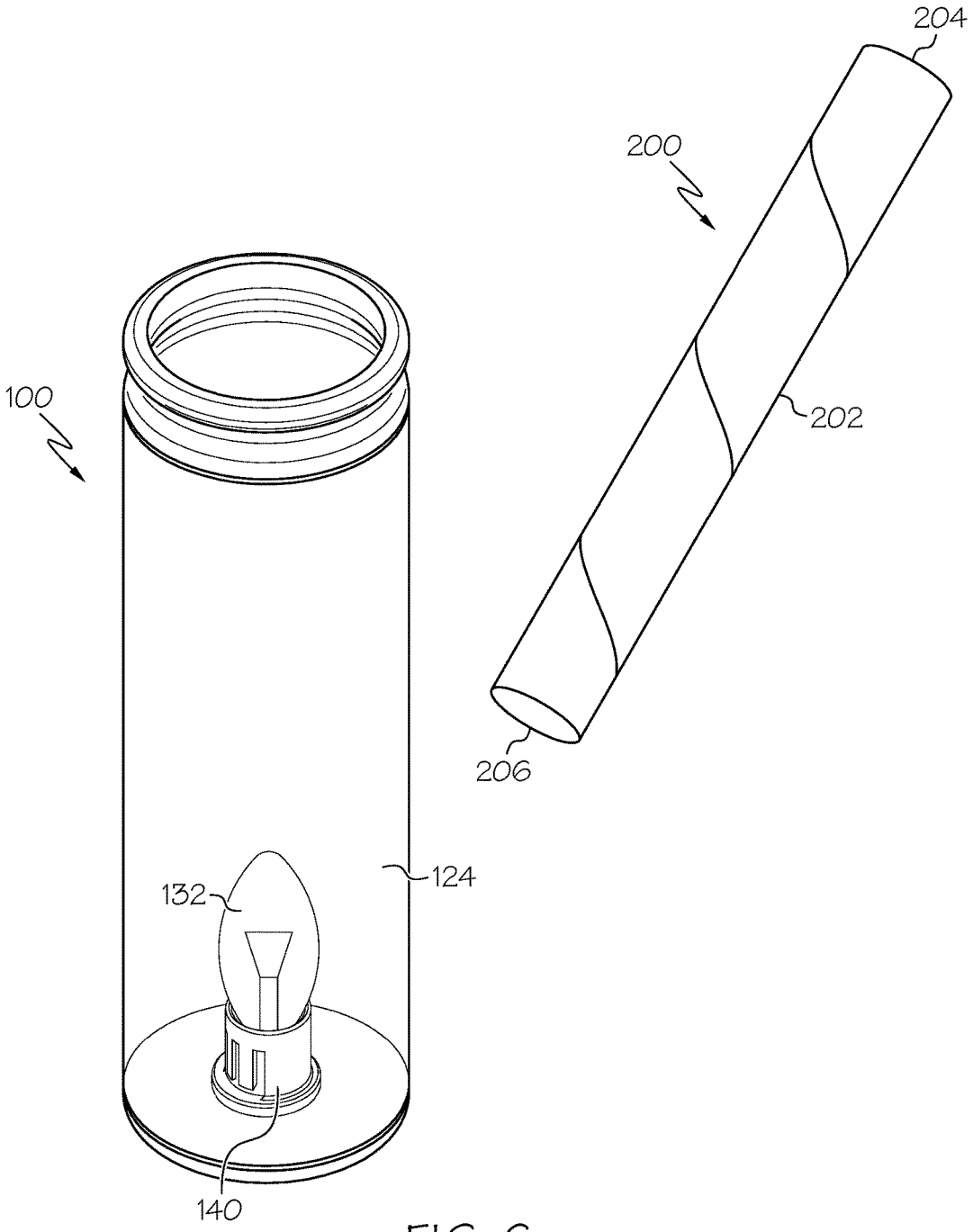
FIG. 6 is a perspective view of an embodiment of a bulb removal tool, in accordance with aspects of the present invention.

FIG. 6 is a perspective view of an embodiment of a bulb removal tool 200, in accordance with aspects of the invention.

The tool 200 can take the form or generally include a tubular body 202 having first and second ends 204, 206, respectively. The second end 206 is configured to receive a light bulb, such as light bulb 132. The second end 206 can be constructed to receive the light bulb with a modest compression and gripping fit that does not break outer bulb 170, for example, when the bulb is received into the second end 206, after which a rotational force can be applied to remove the bulb or put in place a new bulb. The tool 200 may be configured of materials that are not electrically and/or thermally conductive, and/or may be configured of materials that have electrical and/or thermal insulation properties to protect a user.

The tool 200 can be formed of non-disposable or disposable materials. In some embodiments, the tool can be formed of cardboard or the like, that is, materials that do not rip or damage easily and that are not likely to damage a light bulb. Alternatively, the tool can be formed of one or more materials including, but not limited to, plastic, metal, wood, rubber, or the like, or a combination thereof. Again, the portion of the tool configured to receive the bulb, should have sufficient pliability that it does not break the bulb.

At least one of the ends 204, 206 includes or defines an opening that is constructed and arranged for receiving at least a portion of a bulb 132 threaded in a candle apparatus bulb socket 140, for example, a candle apparatus 100 described herein. One end, for example, the second end 206, can be referred to as a distal end and the other end, for example, the first end 204, can be referred to as a proximal end.

The tool 200 can include dimensions that permit the tool to be inserted into an internal cavity 124 of the candle apparatus 100 and have at least an interior portion constructed to conformably receive the bulb 132. In an embodiment, the tool 200 is at or about 7.5-10 inches in length, has a wall thickness at or about 0.060 inches, and/or an inner diameter at the opening of the distal end 206 at or about 0.875 inches. The tool 200 can have other dimensions that permit the tool 200 to receive a bulb 132. For example, the bulb 132 may be a 4 W C4 bulb and the tool 200 can have an inner diameter of 0.875 inches to conformably receive at least a portion of the 4 W C4 bulb and apply a non-breaking, gripping a force that permits the tool 200 to temporarily engage the bulb 132 with a sufficient force to remove the bulb 132 from the socket 140 using a rotational force. The length of the tool is generally chosen based on the depth of the bulb within the candle apparatus 100, such that the tool 200 can access the bulb 132 without the need for a user to force his or her hand into the internal cavity 124 of the candle apparatus 100.

The tool 200 can provide a force that permits the tool 200 to rotate the bulb 132 relative to a socket 140 in which the bulb 132 resides, and to remove the bulb 132 from the internal cavity 124 of the candle apparatus 100. A replacement bulb can be inserted at the distal end 206 of the tool 200 and subsequently inserted into the socket 140 in the interior 124 of the candle apparatus 100.

Figure 7:
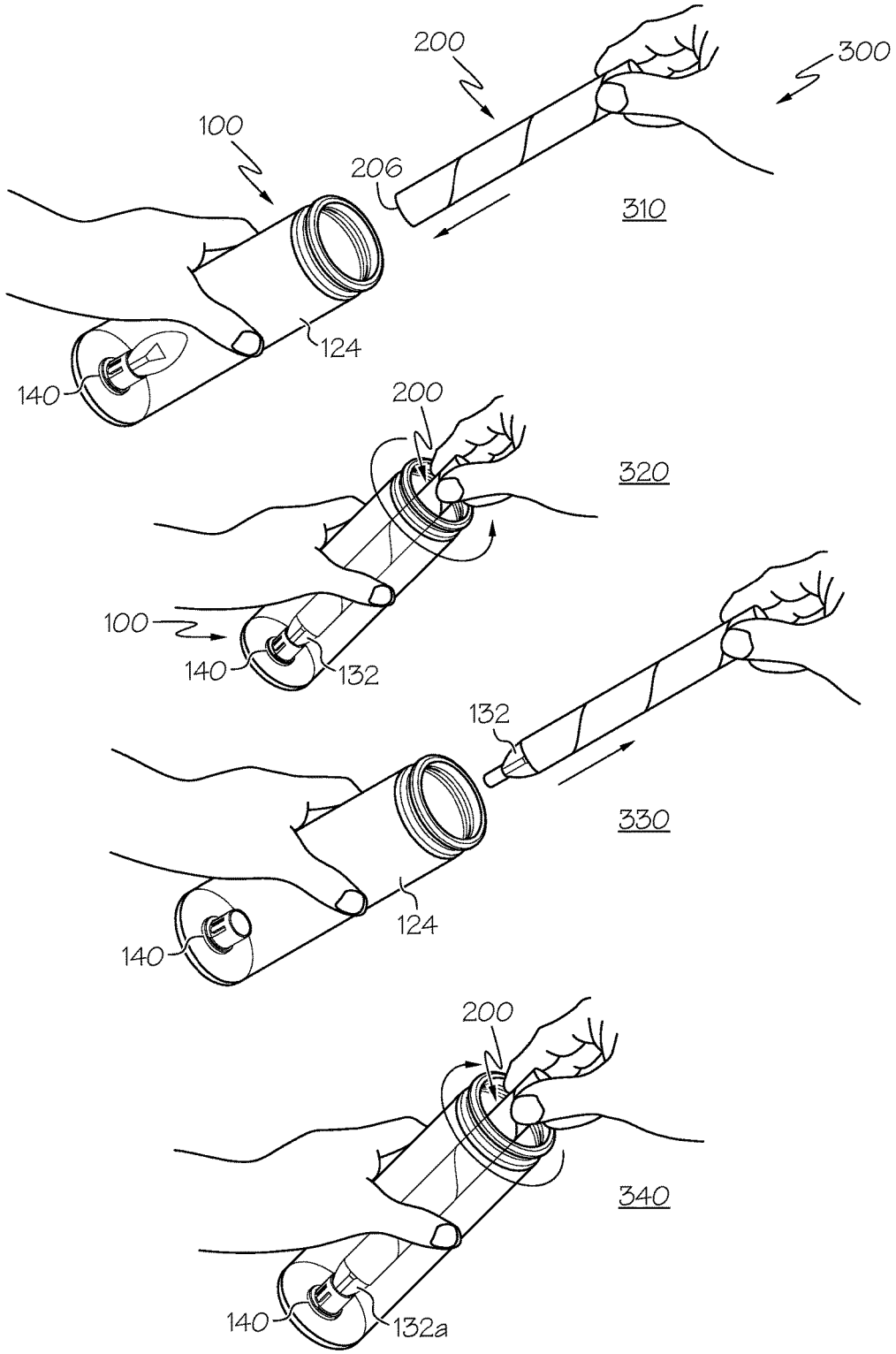
FIG. 7 is a sequence of steps related to an embodiment of a method for changing a bulb of a candle apparatus, in accordance with aspects of the present invention.

FIG. 7 is a series of diagrams demonstrating a sequence of steps related to an embodiment of a method 300 for changing a bulb of a candle apparatus, in accordance with an aspect of the invention.

At step 310, the candle apparatus 100 is preferably, but not essentially, disconnected from an electrical outlet or other power source (not shown) so that a voltage is not applied to the bulb 132. The tool 200 is inserted into the internal cavity 124 of the candle apparatus 100.

At step 320, the distal end 206 of the tool 200 is positioned to receive, and does receive, at least a portion of the bulb 132. A movement of a human hand applied to the tool 200 can translate to a rotation of the tool 200. As shown in step 330, a force by the distal end 206 of the tool 200 generated by the rotation of the tool 200 can result in a rotation of the bulb 132, whereby the bulb 132 can be removed, e.g., unscrewed, from its socket 140, and removed from the candle apparatus 100 by the tool 200.

At step 340, a replacement bulb 132*a* can be inserted into the socket 140 of the apparatus 100 by removably coupling the bulb 132*a* to the tool 200 at the opening at the distal end 206 of the tool 200. Once a base of the bulb is positioned at the socket of the candle apparatus, the tool 200 can be used to rotate the bulb 132*a*, for example, in a clockwise direction about an axis extending in the direction of extension of the apparatus 100, until the bulb is firmly in place in the socket 140.

In one arrangement, one or more pictures, icons, graphics, designs, colors and/or the like may be appropriately formed on the body 104 or light bulb 132 of the apparatus 100. For instance, customers may be able to upload one or more pictures or graphics (e.g., JPEGs, TIFFs, etc.) to any appropriate web-based platform for printing or otherwise forming on the inner and/or outer surfaces 116, 120 of the body 104 or the outer bulb 170 of the light bulb 132.

As another example, one or more stickers, decals, or other wrapping about at least a portion of the inner and/or outer surface 116, 120 of the candle apparatus 100 with any appropriate graphics or pictures thereon may be sized to be received on the inner and/or outer surfaces 116, 120 of the apparatus 100. In one variation, the stickers or decals may be at least partially opaque or transparent to allow for the transmission of light rays generated by the light bulb 132 through the body 104 and stickers or decals. As a further example, the outer bulb 170 of the light bulb 132 may include one or more desired colors (e.g., yellow, red, etc.)

In various embodiments, the tool and the candle apparatus 100 can collectively form a candle apparatus kit.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the disclosure herein.

The embodiments described hereinabove are further intended to explain best modes known of practicing the inventive concepts and to enable others skilled in the art to utilize the inventive concepts, or other embodiments and with various modifications required by the particular application(s) or use(s) of the inventive concepts. It is intended that the appended claims be construed to include alternative embodiments to the extent permitted by the prior art.

What is claimed is:

1. An apparatus that emulates a candle, comprising:

a single-piece, tubular housing including a closed bottom, an open top, a cylindrical sidewall extending between the closed bottom and open top, and an internal cavity formed between the closed bottom and open top, the cylindrical sidewall integral with and terminating at the closed bottom, the closed bottom having uninterrupted top and bottom surfaces completely sealing the tubular housing at the closed bottom;

a receiver disposed within the internal cavity, the receiver having a support disposed on the top surface of the closed bottom of the housing, and including an electrical interconnection to a power source; and a light bulb positioned within the internal cavity and electrically interconnected to the receiver, wherein the light bulb emits light through the tubular housing in response to the power source supplying electricity to the receiver via a power cord.

2. The apparatus of claim 1, further comprising:

an opening extending through the cylindrical sidewall of the tubular housing, wherein the power cord extends from a side of the receiver and above the top surface of the closed bottom and exits the tubular housing via the opening in the cylindrical sidewall.

3. The apparatus of claim 2, further comprising:

a grommet disposed in the opening, wherein:

the grommet includes a detent configured to prevent the grommet from passing through the opening, the power cord extends through the grommet, and the grommet is configured to prevent movement of the power cord with respect to the tubular housing.

4. The apparatus of claim 1, further comprising:

an in-line switch disposed within the power cord, wherein the in-line switch is operable to selectively limit or allow the flow of electricity from the power source to the receiver.

5. The apparatus of claim 1, further comprising at least one sleeve disposed on the outer surface of the housing and having a semitransparent graphic.

6. The apparatus of claim 1, further comprising at least one semitransparent graphic formed in or on the outer surface of the housing.

7. The apparatus of claim 1, wherein the housing is a tubular glass housing.

8. The apparatus of claim 1, wherein the light bulb is disposed within a bottom third of the housing.

9. The apparatus of claim 1, wherein the receiver is mounted to the closed bottom of the housing.

10. The apparatus of claim 1, wherein the light bulb comprises a light emitting diode (LED) light bulb.

11. The apparatus of claim 1, wherein an outermost edge of the closed bottom is integral with a bottommost edge of the sidewall.

12. The apparatus of claim 1, further comprising a light bulb removal tool, comprising:

an elongated body having a proximal end for use by a user and a distal end configured to removably couple to the light bulb; and a bulb receiver and grip formed at the distal end and configured to receive the light bulb with a compression grip, wherein the tool is configured to apply a rotational force to the bulb in response to a user action applied to the proximal end of the body.

13. A candle apparatus kit, comprising:

a single-piece, tubular housing including a closed bottom, an open top, a cylindrical sidewall extending between the closed bottom and open top, and an internal cavity formed between the closed bottom and open top, the cylindrical sidewall integral with and terminating at the closed bottom, the closed bottom having an uninterrupted top surface completely sealing the tubular housing at the closed bottom;

a receiver disposed within the internal cavity, the receiver disposed on the top surface of the closed bottom of the housing, and including an electrical interconnection to a power source;

a light bulb positioned within the internal cavity and electrically interconnected to the receiver, wherein the light bulb emits light through the tubular housing in response to the power source supplying electricity to the receiver via a power cord; and a light bulb removal tool, comprising:

an elongated body having a proximal end for use by a user and a distal end configured to removably couple to a bulb; and a bulb receiver and grip formed at the distal end and configured to receive the light bulb with a compression grip, wherein the tool is configured to apply a rotational force to the bulb in response to a user action applied to the proximal end of the body.

14. The kit of claim 13, further comprising:

an opening extending through the tubular housing; and a grommet disposed in the opening, wherein the power cord extends through the grommet.

15. The kit of claim 14, wherein the grommet includes a detent configured to prevent the grommet from passing through the opening and the grommet is configured to prevent movement of the power cord with respect to the tubular housing.

16. The kit of claim 13, further comprising:

an in-line switch disposed within the power cord, wherein the in-line switch is operable to selectively limit or allow the flow of electricity from the power source to the receiver.

17. The kit of claim 13, further comprising at least one sleeve disposed on an outer surface of the housing and having a semitransparent graphic.

18. The kit of claim 13, further comprising at least one semitransparent graphic formed in or on an outer surface of the housing.

19. The kit of claim 13, wherein the light bulb is disposed within a bottom third of the housing.

20. A method of making a candle apparatus, comprising:

providing a single-piece, tubular housing including a closed bottom, an open top, a cylindrical sidewall extending between the closed bottom and open top, and an internal cavity formed between the closed bottom and open top, the cylindrical sidewall integral with and terminating at the closed bottom, the closed bottom having an uninterrupted top surface completely sealing the tubular housing at the closed bottom;

forming an opening near the closed bottom and in the sidewall of the housing, the opening configured to receive a power cord;

installing a receiver within the internal cavity, the receiver configured to secure a light bulb for illumination, the receiver having a support disposed on the top surface of the closed bottom of the housing;

extending an external power cord through the opening to the receiver, and electrically coupling the power cord to the receiver;

mounting the receiver proximate to the closed bottom of the housing; and mounting a light bulb within the receiver.

* * * * *